United States Patent [19]

Liné

[11] Patent Number: 4,583,893

[45] Date of Patent: Apr. 22, 1986

[54] REPROFILING DEVICE FOR RAILS THROUGH CONTINUOUS MILLING

[75] Inventor: Henri B. Liné, Roquefort les Pins, France

[73] Assignee: Matix Industries (Societe Anonyme), Paris, France

[21] Appl. No.: 608,235

[22] Filed: May 8, 1984

[51] Int. Cl.[4] ..... E01B 31/13

[52] U.S. Cl. ..... 409/138; 409/296; 409/298; 51/178

[58] Field of Search ..... 51/178; 409/157, 178, 409/296, 139, 138, 298; 29/56.5

[56] References Cited

U.S. PATENT DOCUMENTS

| | | | |
|---|---|---|---|
| 1,587,962 | 6/1926 | Kielley . | |
| 1,596,166 | 8/1926 | Everett | 51/178 X |
| 2,077,895 | 4/1937 | Perazzoli | 104/8 |
| 3,707,808 | 1/1973 | Danko | 51/178 |
| 4,197,043 | 4/1980 | Houghton | 409/138 |
| 4,309,846 | 1/1982 | Theurer et al. | 51/178 |
| 4,365,918 | 12/1982 | Theurer | 409/296 |
| 4,490,947 | 1/1985 | Theurer et al. | 409/298 |

FOREIGN PATENT DOCUMENTS

| | | | |
|---|---|---|---|
| 1014874 | 8/1957 | Fed. Rep. of Germany . | |
| 2118209 | 2/1972 | Fed. Rep. of Germany . | |
| 1197642 | 12/1959 | France . | |
| 2333897 | 7/1977 | France . | |
| 817826 | 8/1959 | United Kingdom . | |
| 1031763 | 6/1966 | United Kingdom . | |
| 2056345 | 3/1981 | United Kingdom | 409/139 |

*Primary Examiner*—Jimmy C. Peters

*Attorney, Agent, or Firm*—Young & Thompson

[57] ABSTRACT

The device comprises a support member (8) linearly displaceable with respect to a fixed or movable rail (1). The support member (8) comprises a milling tool (5), cutting depth reference guides (6) for the tool bearing on the top face of the rolling surface (2) of the rail along a plane tangent to the rail and lateral cutting depth reference guides of the tool bearing on the lateral face (2). The top and lateral guides are mounted for rotation about a common shaft and are disposed in front of the milling tool in the direction of displacement. The invention is used to reprofile the rails of a railroad track.

9 Claims, 16 Drawing Figures

REPROFILING DEVICE FOR RAILS THROUGH CONTINUOUS MILLING

The present invention has for its object a device for reprofiling rails by means of continuous milling.

All the reprofiling machines for rails by continuous milling comprise several milling units, having generally an horizontal or inclined axis, each of which machines a portion of the profile. This construction is onerous at the time of the investment but also for its maintenance and for the tools.

On the other hand, the guiding which serves as reference to the cutting depth is made by one or several rollers in contact with the upper face of the head of the rail. This design has a very great drawback because the rails to be reprofiled have undulations of a variable wavelength of 3 to 30 centimeters, undulations which are reproduced by the milling cutters and cause a machining of bad quality.

Finally, the lateral guiding is often made on the web of the rail and does not take into account the tolerances in thickness (maximum 1.5 mm.) of the welded elements.

In FIG. 1, there is shown a rail 1 wherein the profile of its rolling surface 2 or head is represented at its new state in interrupted lines and the worn profile is shown in full lines. It comprises a flange 2*a* due to stoving, which in the case shown corresponds to a left worn rail. As indicated before, it is not possible for the device to be guided on the web 3 and on the foot 4 due to the tolerances in the welded elements.

To remedy the above-mentioned drawbacks, the milling is done with only one unit having a vertical or slightly inclined axis machining the whole profile in only one phase. The guiding is done in taking for reference the upper face of the head 2 along a plane $XX_1$ (FIG. 2) tangent to the rail and in taking as reference a lateral face 2*b* of the head 2 along a plane $YY_1$ (FIG. 2).

According to the present invention the device comprises a support member having a linear displacement with respect to the fixed or movable rail, the said support member comprising in front of the milling tool, with respect to the direction of displacement, tool cutting depth reference guiding means on the upper face of the rolling surface of the rail along a plane $XX_1$ which is tangent to the rail as well as lateral tool cutting depth reference means on the lateral face of the rolling path of the rail along a plane $YY_1$.

The use of the horizontal guiding of the tangent plane $XX_1$ (FIG. 2) enables integrating the undulations due to the wearing off of the rail and the vertical guiding along the plane $YY_1$ (FIG. 2) is not influenced either by the differences in thickness and width of the welded elements of the rail nor by the inscriptions protruding from the web of the rail.

The guiding of the totality of the rail profile is made at once with only one milling cutter working in the best cutting conditions, said milling cutter being continuous thanks to the great number of teeth in engagement and realising a machining of the same type as a surfacing. The design of the milling device enables the passage, without any loss of time, from the machining of a rail worn at the right to the machining of a rail worn at the left. Finally according to a special realisation, the milling device is mounted on a driving member enabling the machining of the rail when fixed on the track.

Other characteristics and advantages of the invention will be better understood when reading the specifications which follow of several embodiments with reference to the drawing, in which.

Figure 1:
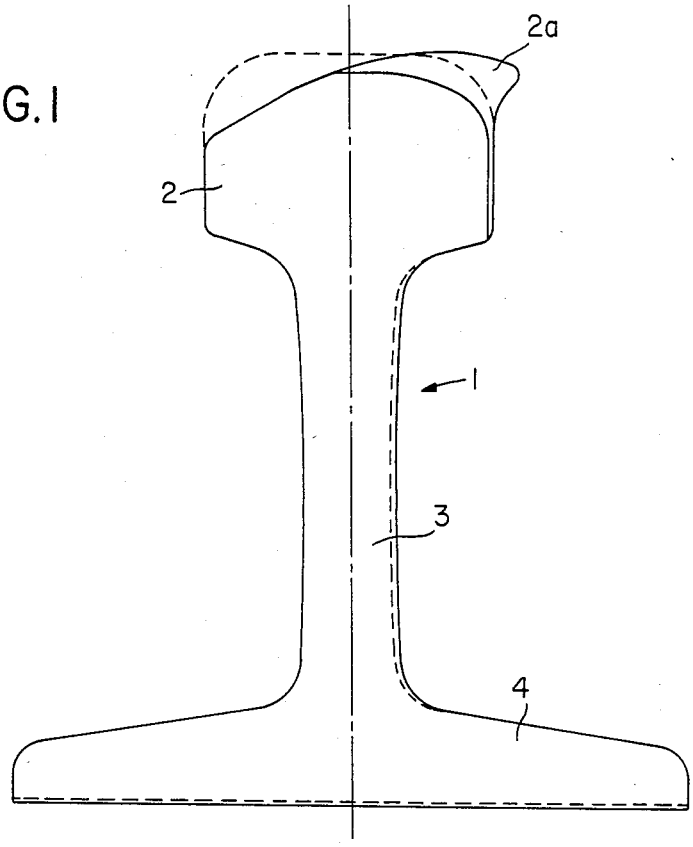
FIG. 1 is a cross section of a worn rail.
Figure 2:
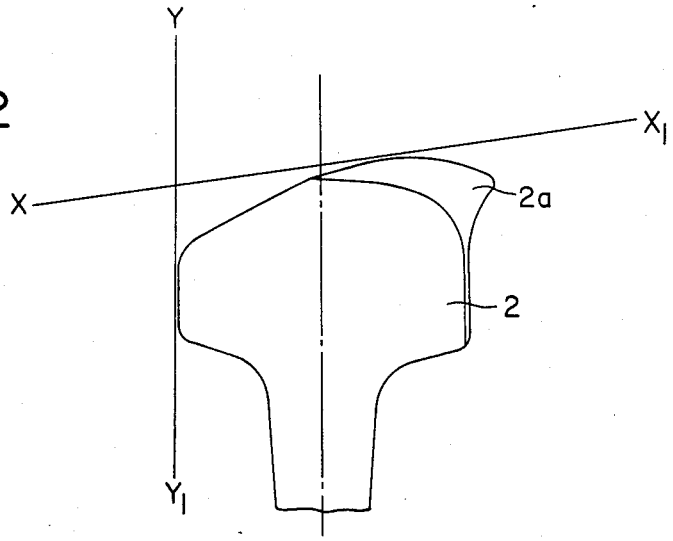
FIG. 2 is a partial cross section of a worn rail and of guiding planes.
Figure 3:
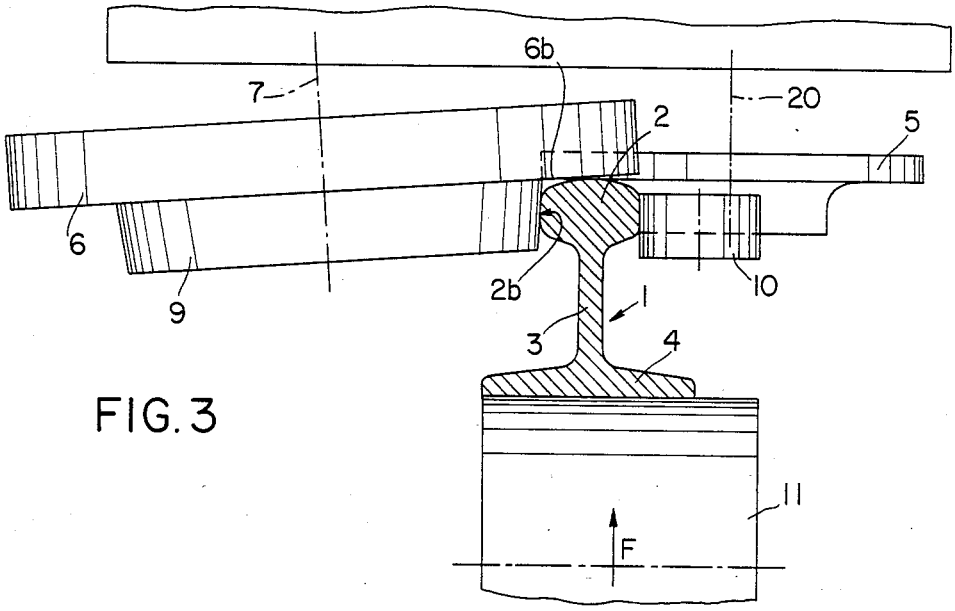
FIG. 3 is an elevation view of the guiding device of the rail before milling according to the invention.
Figure 4:
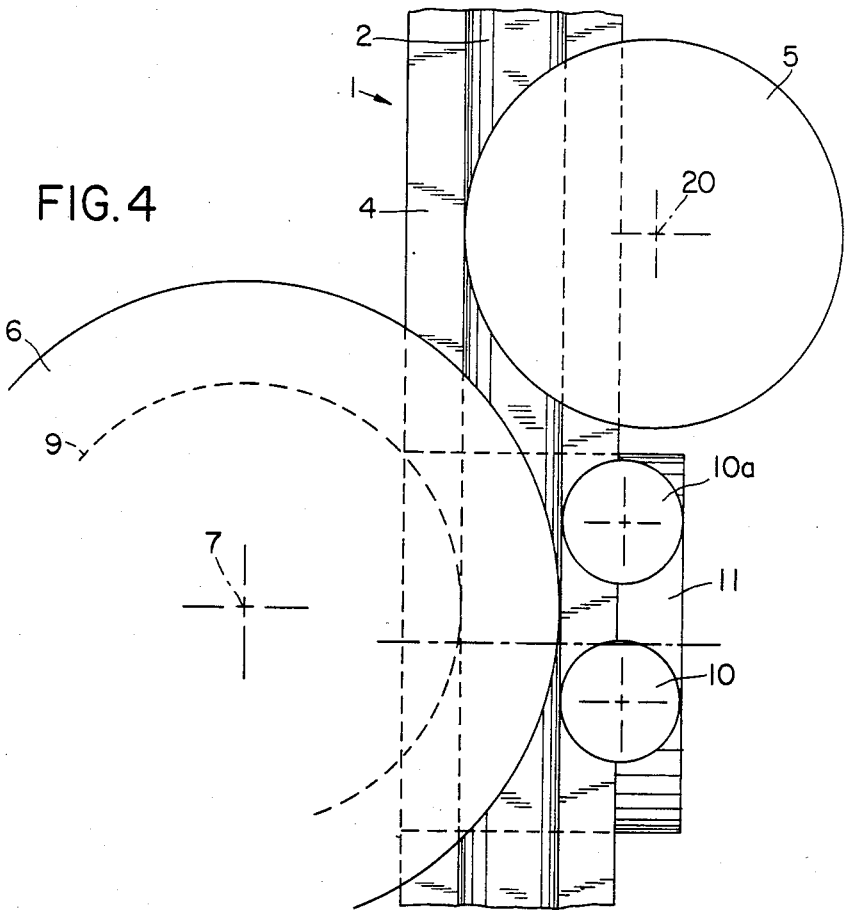
FIG. 4 is a top view of the device shown at FIG. 3.

The device according to the invention shown at FIGS. 3 and 4 is used to reprofile a rail 1 which displaces with respect to the reprofiling devices and which presents after wearing off a flange 2*a* as shown at FIG. 2.

To this effect, the reprofiling device according to the invention comprises a shaped milling cutter 5 ensuring the machining of the rolling path 2 of the rail and guiding means of the milling cutter located in front of the milling cutter 5 which are constituted by a plate 6 freely rotated on a shaft 7 fast with a support member 8, the said plate 6 being in contact by one of its faces 6*b* with the upper face of the rolling path of the rail along a plane $XX_1$ (FIG. 2) which is tangent to the rail. The plate, the axis of which 7 is vertical or slightly inclined provides for the reference guiding of the cutting depth of the milling cutter 5.

Furthermore, another reference guiding means for the lateral cutting depth of the milling cutter 5 is constituted by a conical roller 9 connected to the plate 6 and freely rotated on the same axis 7 as the said plate. The conical roller 9 is in contact with the lateral face 2*b* of the rolling path 2 or head of the rail and it cooperates with two movable bearing rollers 10, 10*a* the axes of which are located on either sides of the plane passing through the shaft 7 of the plate 6.

Figure 5:
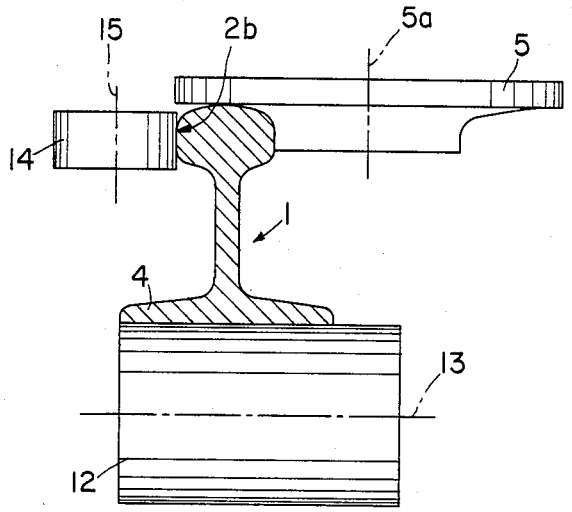
FIG. 5 is an elevation view of the rail guiding means in the milling plane.

The rail 1 is applied against the plate 6 through its sole 4 in contact with a bearing and driving roller 11 of the rail 1 which is displaced linearly with respect to the reprofiling device, the said roller 11 being driven in rotation by motor means not shown and pushed upwardly with a force F by a non-represented member. In the milling plane shown at FIG. 5, the rail 1 rests through it sole 4 on a bearing roller 12 the shaft 13 of which is movable. This shaft is automatically locked in position when a rail enters and comes out of the device, i.e. when one of the front or rear guiding means is no longer in contact with the rail. A lateral bearing roller 14 the axis 15 of which is fixed is in contact with the lateral face 2*b* of the rolling path of the rail, on the side opposite the milling cutter 5.

Figure 6:
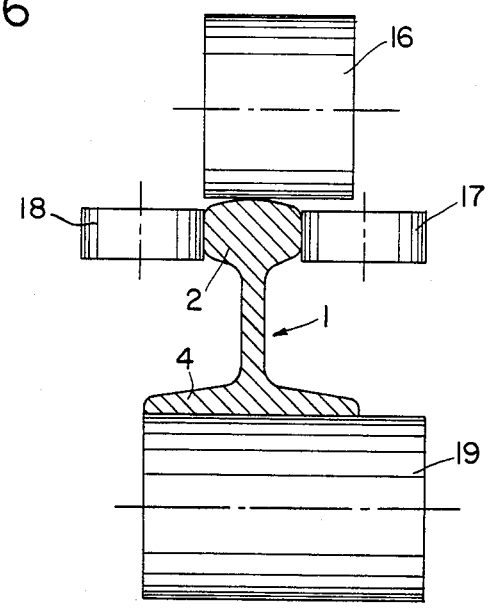
FIG. 6 is an elevation view of the guiding means after milling.
Figure 7:
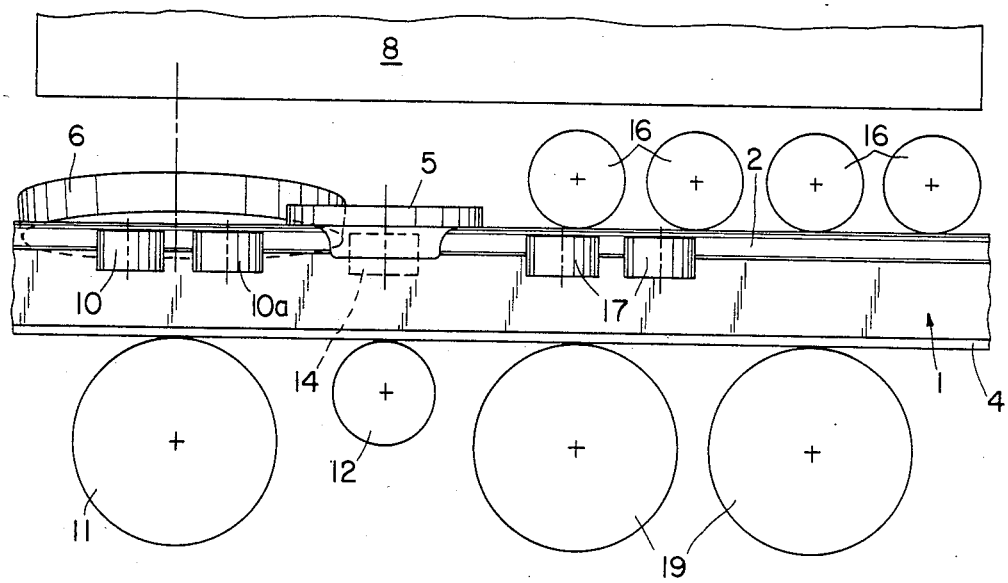
FIG. 7 is a lateral elevation view of a rail guiding and milling installation.
Figure 8:
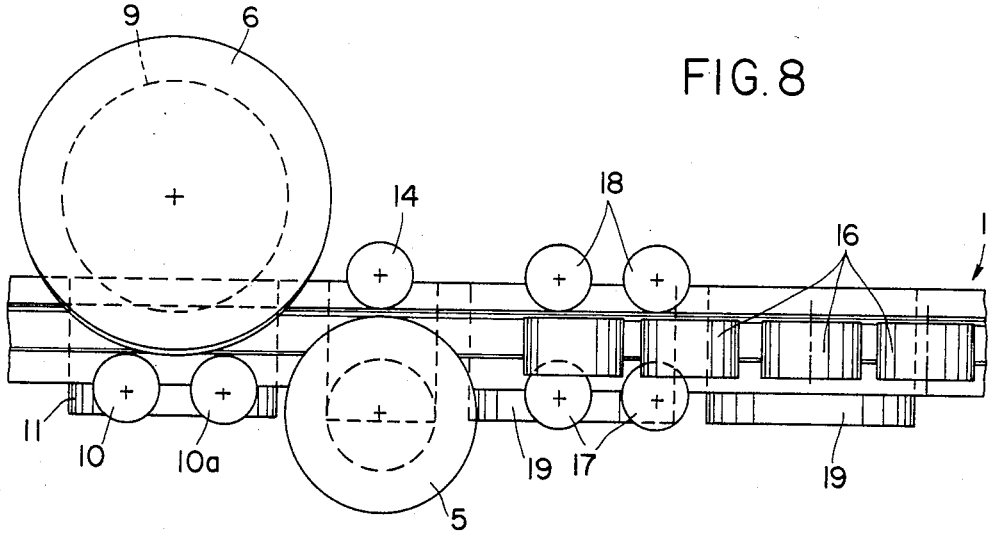
FIG. 8 is a top view of the installation shown at FIG. 7.

As shown at FIGS. 6, 7, 8 and rearwardly of the milling cutter, reference bearing rollers 16 are mounted on the support member 8 and bear on the upper face of the rail, the axes of said roller 16 being adjustable in position but are locked during the milling operation. Furthermore, rollers 17, 18 are located on either side of the lateral faces of the rolling path 2.

Finally the sole 4 of the rail rests on bearing roller 19 which are driven in rotation by the motor means and pushed upwardly to cause the linear displacement of the rail 1 in combination with the roller 11.

To quickly change from the machining of a rail worn at the left side to the machining of a rail worn at the right side, the reprofiling device is made as shown at FIGS. 9, 10, 11, 12 by two guiding and milling units disposed symetrically with respect to a longitudinal axis.

The two units fast with the same support member comprise two shafts 20, 20*a* carrying the milling cutters 5, 5*a* the axes of which are parallel and revolving in opposite directions, two plates 6, 6*a* for the reference guiding of the cutting depth and two conical rollers 9, 9*a* for the lateral reference.

The lateral bearing rollers 10, 10*a*, 10*b*, 10*c* are mounted on a carriage 21 displaceable laterally along the double arrow F1 to come into contact selectively with one of the lateral faces of the rolling path of the rail.

Figure 9:
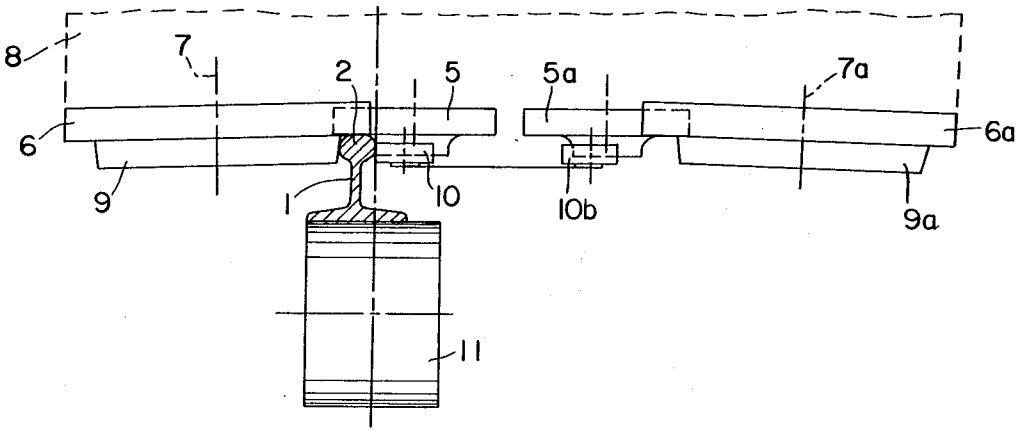
FIG. 9 is a front elevation view of a milling unit during a machining operation of the right side.

When reprofiling a rail 1 worn on the left side, this rail is mounted as shown in FIG. 9, so that the milling cutter 5 contacts the portion deformed to the right of the rolling path or head of the rail 2, the plate 6 contacts the upper portion of said rolling path 2 and the conical roller 9 contacts the lateral face 2*b* opposite the lateral face machined by the milling cutter. In this case the carriage 21 is displaced so that the rollers 10, 10*a* contact the lateral face of the rolling path 2 opposite the conical roller 9, the rail 1 resting on and being driven by the driving roller 11.

Figure 10:
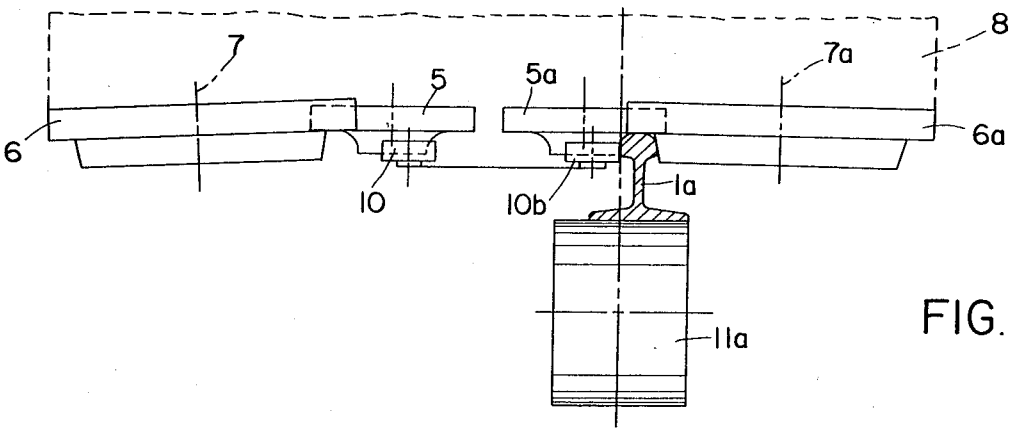
FIG. 10 is a face elevation view of a milling unit during a machining operation of the left side.
Figure 11:
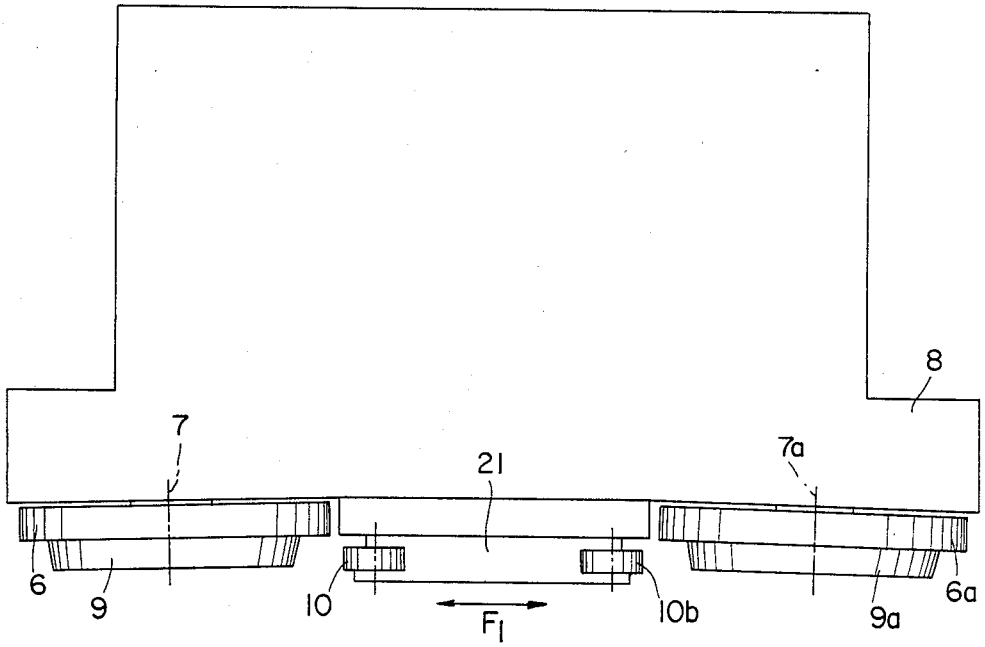
FIG. 11 is an elevation view of a milling unit for reprofiling of the right and left sides of rails.
Figure 12:
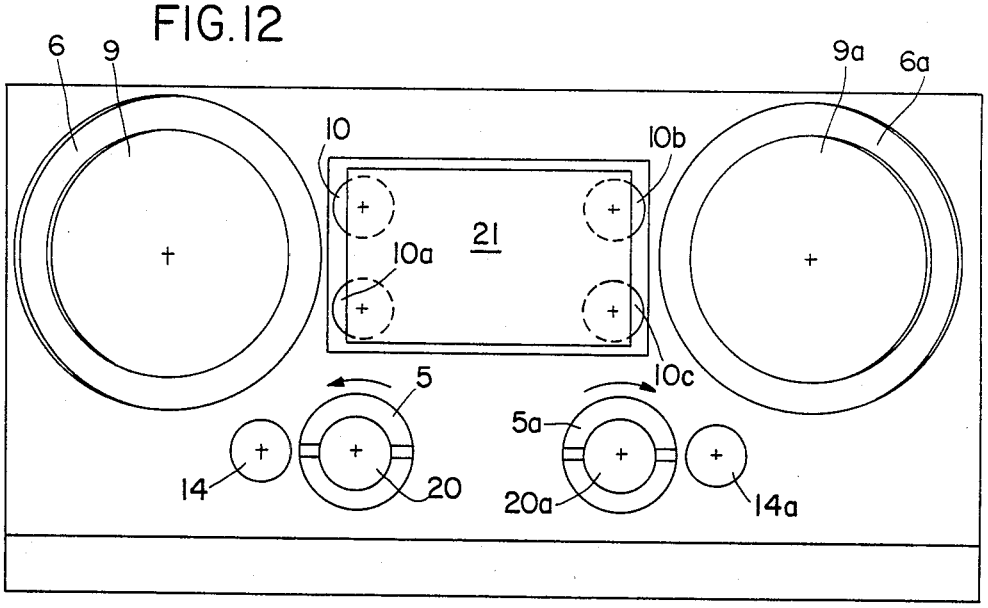
FIG. 12 is a top view of the milling unit shown at FIG. 11.

To reprofile a rail worn on the right side, it is mounted as shown in FIG. 10, so that the machining is effected by the milling cutter 5*a* and the upper and lateral guiding by the plate 6i a and the conical roller 9*a*, respectively.

At FIGS. 13, 14, 15 and 16 another embodiment of the device is shown in which the reprofiling is made on one or two rails 1 fixed on a railroad track and in this case the guiding and machining device is movable with respect to the rail which is fixed.

Figure 13:
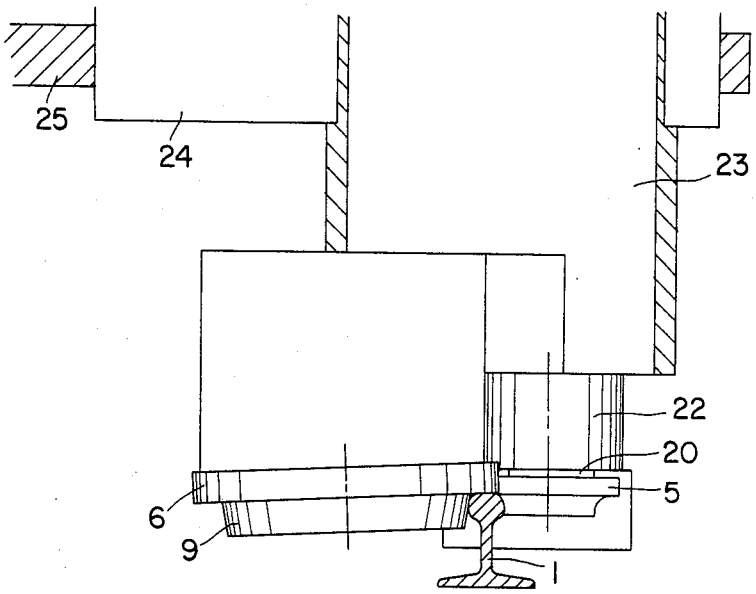
FIG. 13 is an elevation view of a guiding and machining head on a rail fixed on a track.
Figure 15:
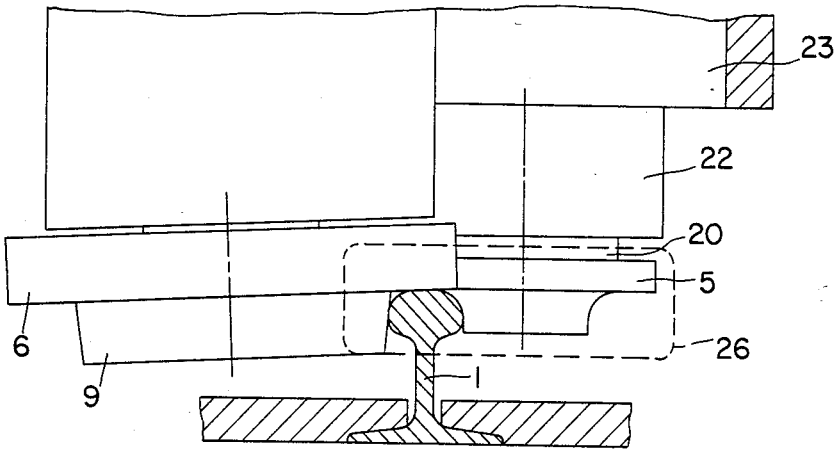
FIG. 15 is a view at greater scale of the guiding and reprofiling device of a rail fixed on a track.
Figure 16:
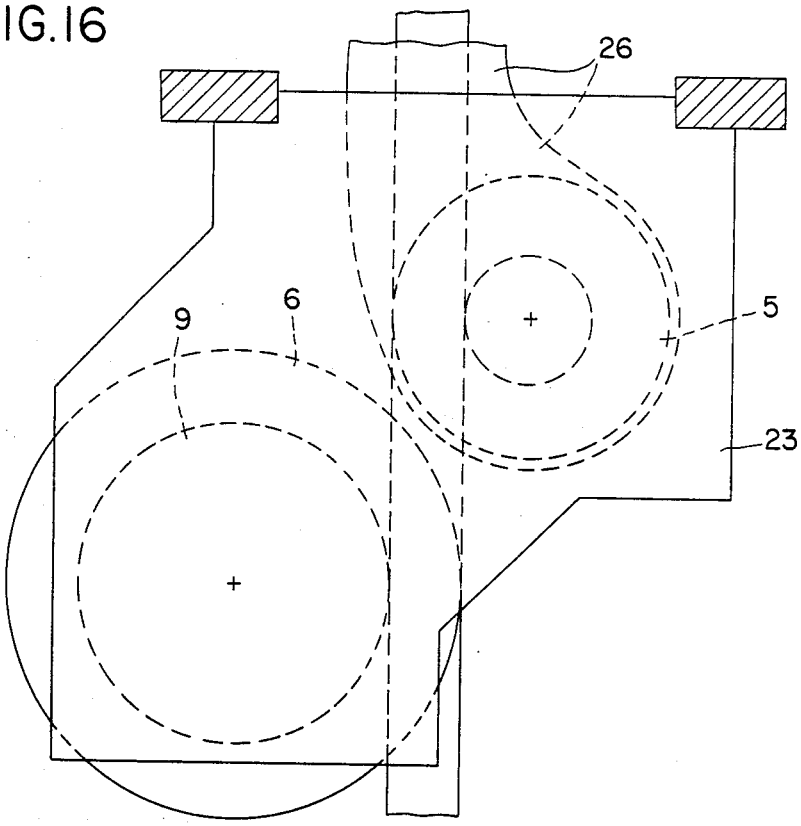
FIG. 16 is a top view of the body of the sliding head bearing the milling cutter and the guiding means.

The device shown in FIGS. 13, 15 and 16 comprises a milling cutter 5 the shaft 20 of which is rotatively mounted in a sleeve 22 slidably mounted for vertical displacement in a machining head 23 which carries also in front of the milling cutter 5 guiding means formed by the plate 6 and the conical roller 9 as described above. The machining head 23 is slidably mounted for vertical displacement on an armature 24 itself slidably mounted for horizontal displacement on a cross member 25 fast with a driving member not shown, permitting the relative displacement of the device with respect to the rail 1 which is fixed.

To provide for the evacuation of the chips of rail generated by the milling, a baffle 26 located around the milling cutter 5 is mounted on the sleeve 22.

Figure 14:
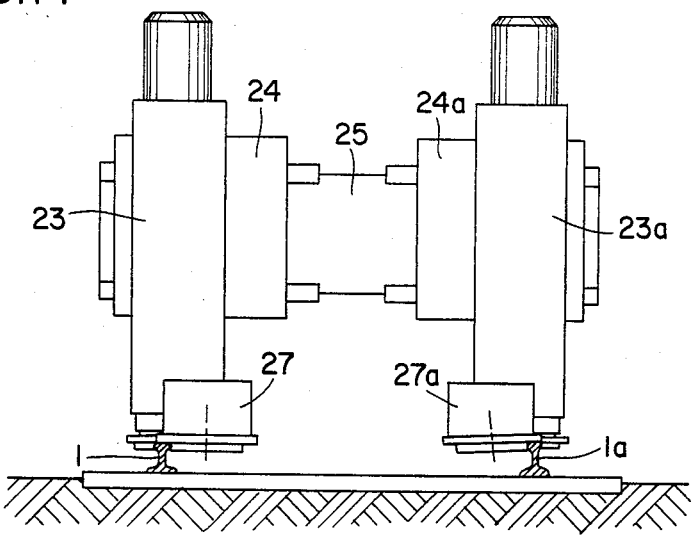
FIG. 14 is an elevation view of a reprofiling assembly for rails fixed on a track.

In FIG. 14 another embodiment of the device is shown, which enables realizing simultaneously the reprofiling of two rails 1, mounted on the railroad track. The device comprises two guiding and machining units 27, 27*a* which are fast with two machining heads 23, 23*a* slidably mounted for vertical movement on armatures 24, 24*a* which are displaced horizontally on a cross-member 25 fast with a driving member not shown and causing the linear displacement of the assembly with respect to the fixed rails 1, 1*a*.

The guiding and milling units 27, 27*a* are designed as the ones represented at FIGS. 13 and 15.

I claim:

1. Device for reprofiling rails by continuous milling, comprising a support member linearly displaceable with respect to a fixed or movable rail, a milling tool rotatably mounted on said support member, reference guiding means of the cutting depth of the tool located before said tool in the direction of displacement comprising a plate rotatably mounted on a shaft extending vertically or slightly inclined with respect to the vertical and fixed to the support member, said plate bearing on the upper face of the rolling path of the rail along a plane tangent to the rail head; and a conical roller for bearing on the lateral face of the rolling path of the rail opposite the face cut by the milling tool, along a plane tangent to the lateral face, said plate and said conical roller being rotatably mounted on the same said shaft.

2. Device as claimed in claim 1, wherein the support member is fixed and the rail is displaced linearly with respect to the said support member, the said rail resting through its foot on driving rollers located forwardly and rearwardly of the milling tool and which maintain the rail applied against the plate and the rollers.

3. Device as claimed in claim 1, and movable bearing rollers disposed for free rotation on vertical shafts fixed to the support member in front of the conical roller in the direction of displacement and on the opposite lateral face of the rolling path.

4. Device as claimed in claim 1, and lateral bearing rollers and a lower movable bearing roller located opposite and beneath the milling tool, respectively, in the direction of displacement.

5. Device as claimed in claim 1, and upper, lower and lateral bearing rollers disposed rearwardly of the milling tool in the direction of displacement.

6. Device as claimed in claim 1, and two milling shafts mounted on the support member, said milling shafts revolving in opposite directions and each carrying a milling cutter associated with bearing rollers to machine selectively a rail worn on the left side or on the right side, and there being, mounted forwardly of the two machining shafts in the direction of displacement, two cutting depth reference plates and two lateral cutting depth reference conical rollers associated with movable bearing rollers.

7. Device as claimed in claim 1, the reference guiding means and the milling tool being mounted on a machining head, said machining head being slidably mounted for vertical displacement in an armature which is slidably mounted for horizontal movement on a fixed cross member located on driving means movable with respect to a rail fixed to the railroad track.

8. Device as claimed in claim 7, the milling shaft being fixed to a sleeve sliding vertically on the machining head, the said sleeve comprising a baffle for evacuating the chips of rail generated by the milling.

9. Device as claimed in claim 7, and two machining heads each comprising a milling shaft and upper and lateral guiding means slidably mounted for vertical displacement on two armatures horizontally displaceable on a cross member fixed to driving means movable with respect to the rails fixed to the railroad track.

* * * * *